US006373456B1

(12) United States Patent
Matsubara

(10) Patent No.: US 6,373,456 B1
(45) Date of Patent: Apr. 16, 2002

(54) LIQUID CRYSTAL DISPLAY

(75) Inventor: Ryouta Matsubara, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 0 days.

(21) Appl. No.: 09/349,502

(22) Filed: Jul. 9, 1999

(30) Foreign Application Priority Data

Jul. 13, 1998 (JP) ..... 10-196874

(51) Int. Cl.[7] ..... G09G 3/36
(52) U.S. Cl. ..... 345/94; 345/87; 345/96
(58) Field of Search ..... 345/87, 90, 92, 345/94, 96

(56) References Cited

U.S. PATENT DOCUMENTS 5,585,816 A * 12/1996 Scheffer et al. ..... 345/100
5,760,757 A * 6/1998 Tanaka et al. ..... 345/93
5,784,039 A * 7/1998 Yasui et al. ..... 345/89
5,977,940 A * 11/1999 Akiyama et al. ..... 345/94
5,982,348 A * 11/1999 Nakajima et al. ..... 345/92
6,037,924 A * 3/2000 Koyama et al. ..... 345/92
6,067,065 A * 5/2000 Worley, III et al. ..... 345/94
6,084,562 A * 7/2000 Onda ..... 345/94
6,124,839 A * 9/2000 Usui ..... 345/94
6,181,310 B1 * 1/2001 Nomura ..... 345/97

* cited by examiner

*Primary Examiner*—Richard Hjerpe
*Assistant Examiner*—Kimnhung Nguyen
(74) *Attorney, Agent, or Firm*—McDermott, Will & Emery

(57) ABSTRACT

In the conventional liquid crystal display, there exists a problem in display that shortage in voltage applied to a liquid crystal and crosstalk occur because of delay in waveform of a common potential Vcom.

A liquid crystal display has a drive circuit for applying a gate potential Vg having a High potential setting a gate line 1 to a selection level and a Low potential setting the gate line to a non-selection level to the gate line 1 of a display panel, comprises a common potential generation circuit for applying a common potential Vcom inverting to a high potential or a low potential for each horizontal scanning period to a common electrode 10 of the display panel, an auxiliary electrode connected to a picture element electrode 6 through an auxiliary capacity 7 is provided, the auxiliary electrode is connected to a common line, Low potential changed synchronizing with the high potential and low potential of the common potential Vcom and with respect to a potential difference between the second voltage and the common potential, the potential difference at the high potential of the common potential is equal to that at the low potential of the common potential.

3 Claims, 6 Drawing Sheets

LIQUID CRYSTAL DISPLAY

BACKGROUND OF THE INVENTION

1. Field of the Invention

The present invention relates to a liquid crystal display and, more particularly, to a drive circuit of a liquid crystal display.

2. Prior Art

FIG. 3 is a diagram showing an equivalent circuit of an active matrix liquid crystal display.

In the drawing, reference numeral 1 indicates a gate line comprising a plurality of wires disposed in parallel. Numeral 2 indicates a source line orthogonal to the gate line 1 and comprising a plurality of wires disposed in parallel. Numeral 3 indicates a thin film transistor serving as a switching element. A gate electrode 4 is connected to the gate line 1, a source electrode 5 is connected to the source line 2, and a drain electrode is connected to a picture element electrode 6, respectively.

Numeral 7 indicates an auxiliary capacity (Cs) connected between the picture element electrode 6 and an auxiliary electrode 8, and numeral 9 indicates a liquid crystal capacity (Clc) connected between the picture element electrode 6 and a common electrode 10. The common electrode 10 and the auxiliary electrode 8 are connected to a Cs line serving as a common line not illustrated.

FIG. 4 is a diagram showing a common inversion drive of common Cs line of a liquid crystal display according to a prior art.

In the drawing, reference numeral 1 indicates a gate line, numeral 10 indicates a common electrode, and numeral 11 indicates a capacity between the gate line and the common electrode. Vg indicates a gate potential which is a selection pulse signal, and Low potential of the gate potential is a constant value. Vcom indicates a common potential applied to the common electrode, and Vs is a source potential which is a gradation signal.

FIG. 5 is a diagram showing a shortage of voltage applied to the liquid crystal because of shortening of horizontal scanning period of the conventional liquid crystal display.

In the drawing, Vp is a picture element potential applied to the picture element electrode, Vcom is a common potential applied to the common electrode, and Vlc is a liquid crystal voltage applied to the liquid crystal.

FIG. 6 is a diagram showing an increase of crosstalk ratio because of shortening of horizontal scanning period of the conventional liquid crystal display.

In the conventional active matrix liquid crystal display of above arrangement, as shown in FIG. 3, a plurality of gate wires 1 and source wires 2 are aligned forming a matrix. And the thin film transistor 3 and the picture element electrode 6 are formed in a region surrounded by those wires. In such an active matrix liquid crystal display, in case of line common inversion drive of common Cs structure, the gate potential Vg serving as a selection pulse signal is inputted to the gate line 1 on the basis of sequential line scanning. The thin film transistor 3 formed in the picture element on the selected gate line 1 is turned on. The source potential Vs serving as a gradation signal of horizontal scanning period is applied to the source line 2, and the common signal Vcom of horizontal scanning period is applied to the common electrode 10 and the auxiliary electrode 8, thus the active matrix liquid crystal display is driven. However, in such a conventional drive system, as shown in FIG. 4, the Low potential being a non-selective potential of the gate potential Vg applied to the gate line 1 is a constant value.

FIG. 3 shows one picture element equivalent circuit of common Cs structure of the active matrix liquid crystal display. When the gate potential Vg being a selection pulse signal is inputted to the gate line 1, the thin film transistor 3 formed in the picture element on the gate line 1 is turned on, and the source potential Vs being a gradation signal applied to the source line 2 is written in the picture element electrode 6 through the thin film transistor 3, whereby the voltage Vlc applied to the liquid crystal and formed by a potential difference between the picture element potential Vp and the common potential Vcom is applied to the liquid crystal held between the picture element electrode 6 and the common electrode 10. At this time, the voltage applied to the liquid crystal is subject to a field through due to last transition of the gate potential Vg, whereby a voltage Vlc' applied to the liquid crystal during the holding period becomes Vlc' smaller than Vlc. By establishing the Low potential of the gate potential Vg applied to the gate line 1 to be a constant value, the voltage Vlc' applied to the liquid crystal during the holding period turns off the thin film transistor 3 and is held during the vertical scanning period.

In the conventional drive system described above, when the common potential Vcom performs an inversion for each horizontal scanning period, because of a time constant between the capacity formed through the gate line 1, source line 2, picture element electrode 6 and respective liquid crystals and a sheet resistance of the common electrode 10, a delay occurs in waveform of the common potential Vcom inputted to the common electrode 10 of any picture element in the active matrix liquid crystal panel, as compared with waveform of the common potential Vcom inputted to the active matrix liquid crystal panel. As a result, in the aspect of display, there exists a problem of occurrence of shortage in voltage applied to the liquid crystal and crosstalk, because the common potential Vcom does not reach predetermined potential during the horizontal scanning period. Particularly, when the horizontal scanning period is shortened under the recent trend of large-sized and highly defined active matrix liquid crystal panel, occurrence of shortage in voltage applied to the liquid crystal and crosstalk is remarkable.

FIG. 5 shows a manner of occurring a shortage in the voltage applied to the liquid crystal because of the shortening of horizontal scanning period. When the horizontal scanning period is shortened from a horizontal scanning period A to a horizontal scanning period B, the voltage applied to the liquid crystal is lowered, and any predetermined brightness cannot be attained in the active matrix liquid crystal display.

FIG. 6 shows a mechanism of occurring a crosstalk because of shortening of horizontal scanning period, and convergence speed at the time of inversion of the common potential Vcom is different depending upon the source potential Vs which is a gradation signal applied to the source line. Accordingly, in the horizontal scanning period A, irrespective of the source potential Vs, the common potential Vcom applied to the common electrode 10 reaches a predetermined potential. On the other hand, in the horizontal scanning period B, depending upon the source potential Vs applied to the source line 2, the common potential Vcom applied to the common electrode 10 reaches a potential of different level. In this manner, in the horizontal scanning period B, depending upon the source potential Vs applied to the source line 2, the voltage Vlc applied to the liquid crystal is different, which results in the occurrence of crosstalk in the active matrix liquid crystal display.

To solve the above problems, it may be an idea to reduce the parasitic capacity formed between the common electrode 10 and each electrode or to minimize the delay at the time of inversion of the common potential Vcom by improving the charge supply capacity of the power source of the common electrode 10. However, there is a restriction that if wiring width is small, wiring resistance is increased, while if improving the charge supply capacity of the power source, power consumption is increased.

SUMMARY OF THE INVENTION

The invention was made to solve the above-discussed problems and has an object of providing a liquid crystal display capable of reducing the influence on display due to the parasitic capacity between the gate line and the common electrode.

To accomplish the foregoing object, a liquid crystal display according to the invention comprises: a picture element electrode connected to a gate line and to a source line provided orthogonal to said gate line through a switching device; a display panel arranged opposite to said picture element electrode and in which a picture element having a common electrode holding a liquid crystal between the picture element electrode and the common electrode is provided forming a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or to a low potential for each scanning period to the common electrode of the display panel; wherein the second voltage changes synchronizing with the high potential and the low potential of the common potential, and with respect to a potential difference between the second voltage and the common potential, the potential difference at the high potential of the common potential is smaller than that at the low potential of the common potential.

In the picture element, an auxiliary electrode connected to the picture element electrode through an auxiliary capacity is provided, and the auxiliary electrode of each picture element is commonly connected.

A picture element electrode connected to a gate line and to a source line provided orthogonal to said gate line through a switching device; a display panel arranged opposite to said picture element electrode and in which a picture element having a common electrode holding a liquid crystal between the picture element electrode and the common electrode is provided forming a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or to a low potential for each scanning period to the common electrode of the display panel; wherein, in the picture element, an auxiliary electrode connected to the picture element electrode through an auxiliary capacity is provided, the auxiliary electrode of each picture element is commonly connected, the second voltage changes synchronizing with the high potential and the low potential of the common potential, and with respect to a potential difference between the second voltage and the common potential, the potential difference at the high potential of the common potential is equal to that at the low potential of the common potential.

The invention of above arrangement has following advantages.

Since the liquid crystal display comprises a picture element electrode connected to a gate line and to a source line provided orthogonal to said gate line through a switching device; a display panel arranged facing to said picture element electrode and in which a picture element having a common electrode holding a liquid crystal between the picture element electrode and the common electrode is provided to form a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or a low potential for each scanning period to the common electrode of the display panel; wherein the second voltage changes synchronizing with the high potential or the low potential of the common potential, and with respect to a potential difference between the second voltage and the common potential, the potential difference at the high potential of the common potential is smaller than that at the low potential of the common potential, by reducing the transfer of charge between the gate line and the common electrode, it is possible to reduce the influence from parasitic capacity between the gate line and the common electrode, and the delay of the common potential at the time of inversion of the common potential is small.

Further, since the auxiliary electrode connected to the picture element electrode through the auxiliary capacity is provided in the picture element and the auxiliary electrode of each picture element is commonly connected, it is possible to achieve the common inversion drive system of common Cs line.

Furthermore, since a liquid crystal display according to the invention comprises: a picture element electrode connected to a gate line and to a source line provided orthogonal to said gate line through a switching device; a display panel arranged facing to said picture element electrode and in which a picture element having a common electrode holding a liquid crystal between the picture element electrode and the common electrode is provided to form a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or a low potential for each scanning period to the common electrode of the display panel; wherein, in the picture element, an auxiliary electrode connected to the picture electrode element through an auxiliary capacity is provided, the auxiliary electrode of each picture element is commonly connected, the second voltage changes synchronizing with the high potential and the low potential of the common potential, and with respect to the potential difference between the second voltage and the common potential, the potential difference at the high potential of the common potential is equal to that at the low potential of the common potential, by reducing the transfer of charge between the gate line and the common electrode, it is possible to reduce the influence from parasitic capacity between the gate line and the common electrode.

DESCRIPTION OF THE PREFERRED EMBODIMENT

EXAMPLE 1.

Figure 1:
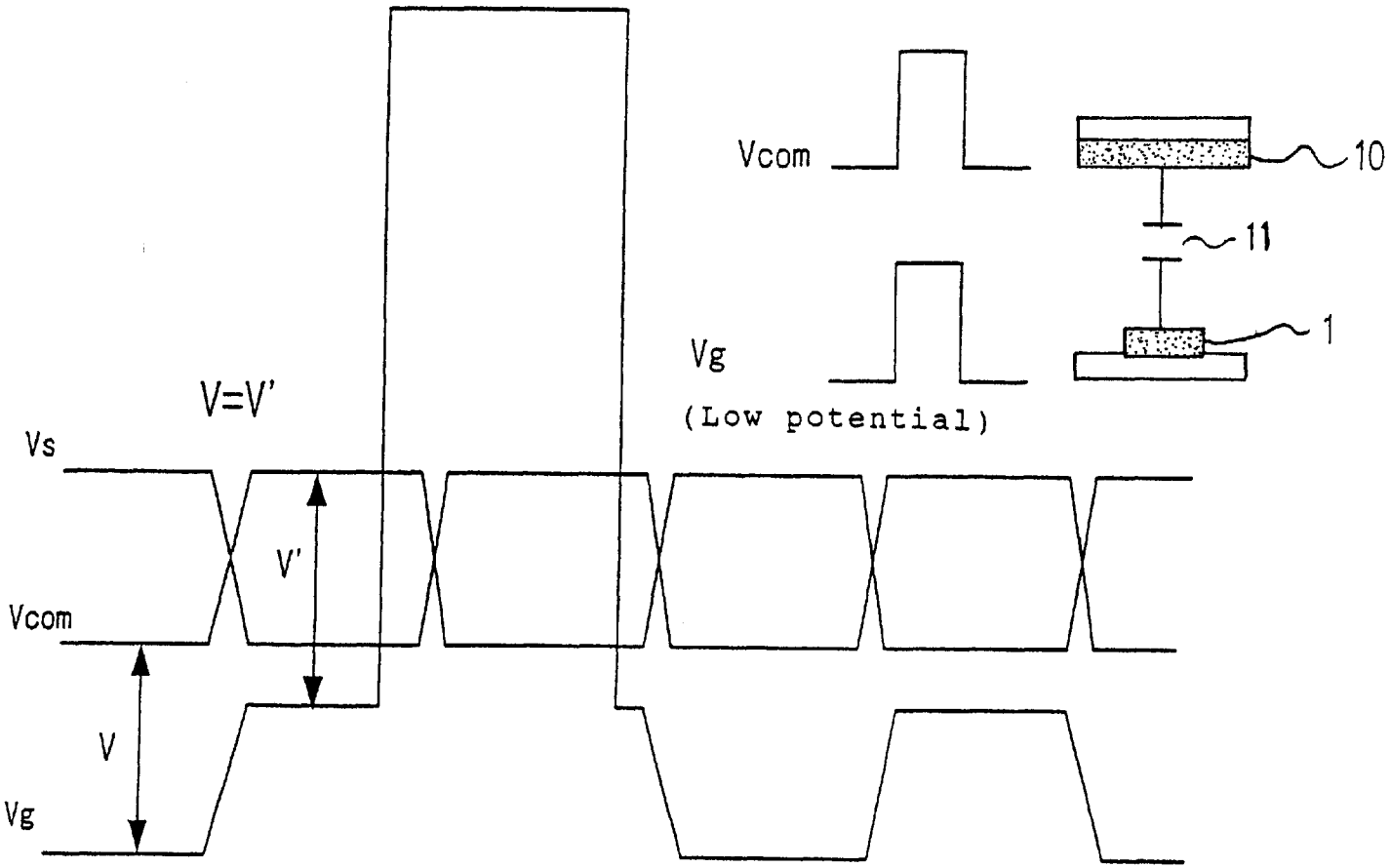
FIG. 1 is a diagram showing a common inversion drive of common Cs line of a liquid crystal display according to example 1 of the present invention.

FIG. 1 is a diagram showing a common inversion drive of common Cs line of a liquid crystal display according to example 1 of the present invention.

In the drawing, reference numeral 1 indicates a gate line, numeral 10 indicates a common electrode, and numeral 11 indicates a capacity between the gate line and the common electrode. Vg indicates a gate potential being a selection pulse signal, and the gate line 1 is selected at High potential being a first voltage, while the gate line is not selected at Low potential being a second voltage. Vcom indicates a common potential applied to the common electrode and supplied from a common potential generation circuit not illustrated. Vs indicates a source potential being a gradation signal.

Figure 3:
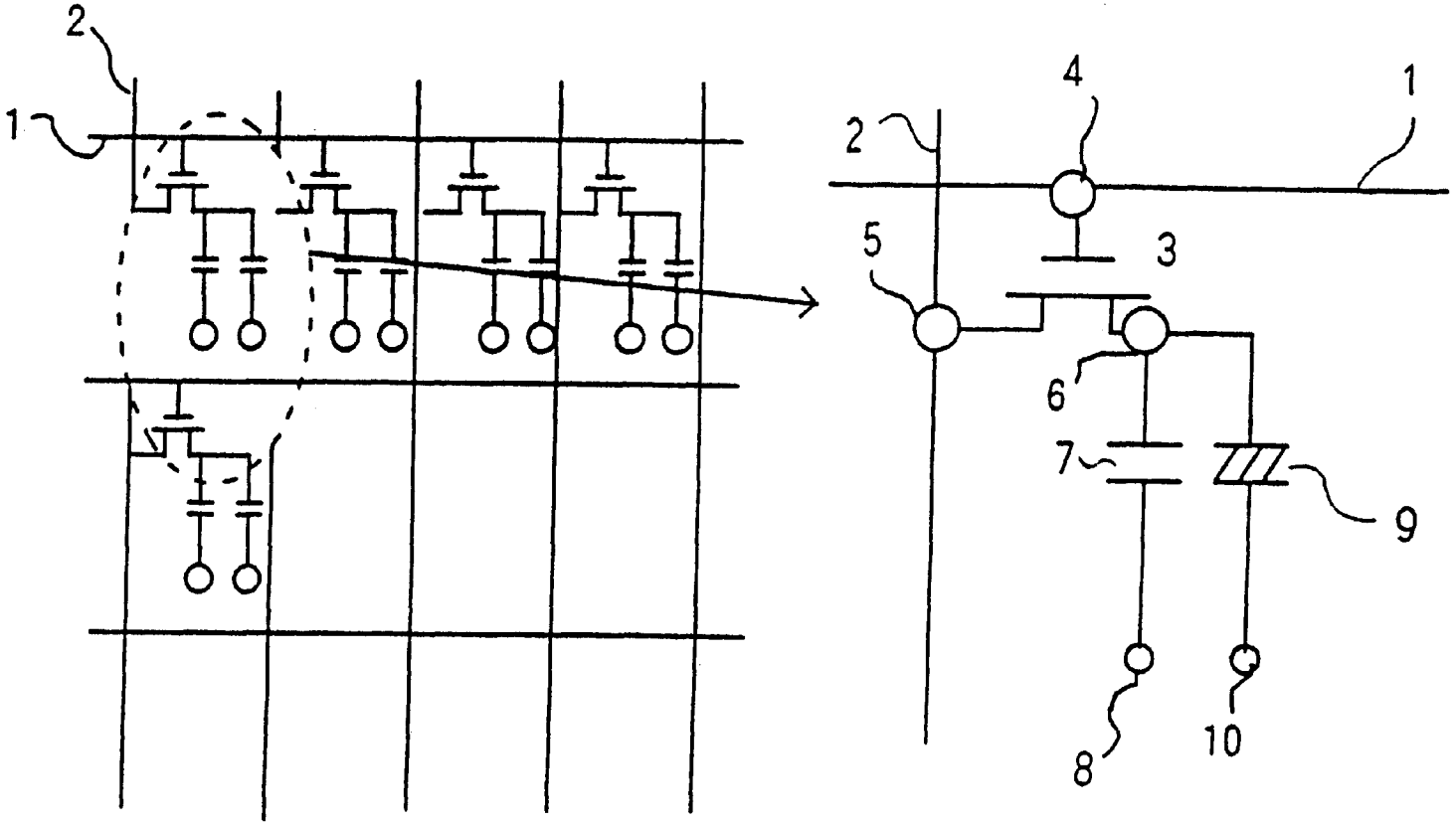
FIG. 3 (PRIOR ART)
FIG. 3 is a diagram showing an equivalent circuit of an active matrix liquid crystal display.
Figure 4:
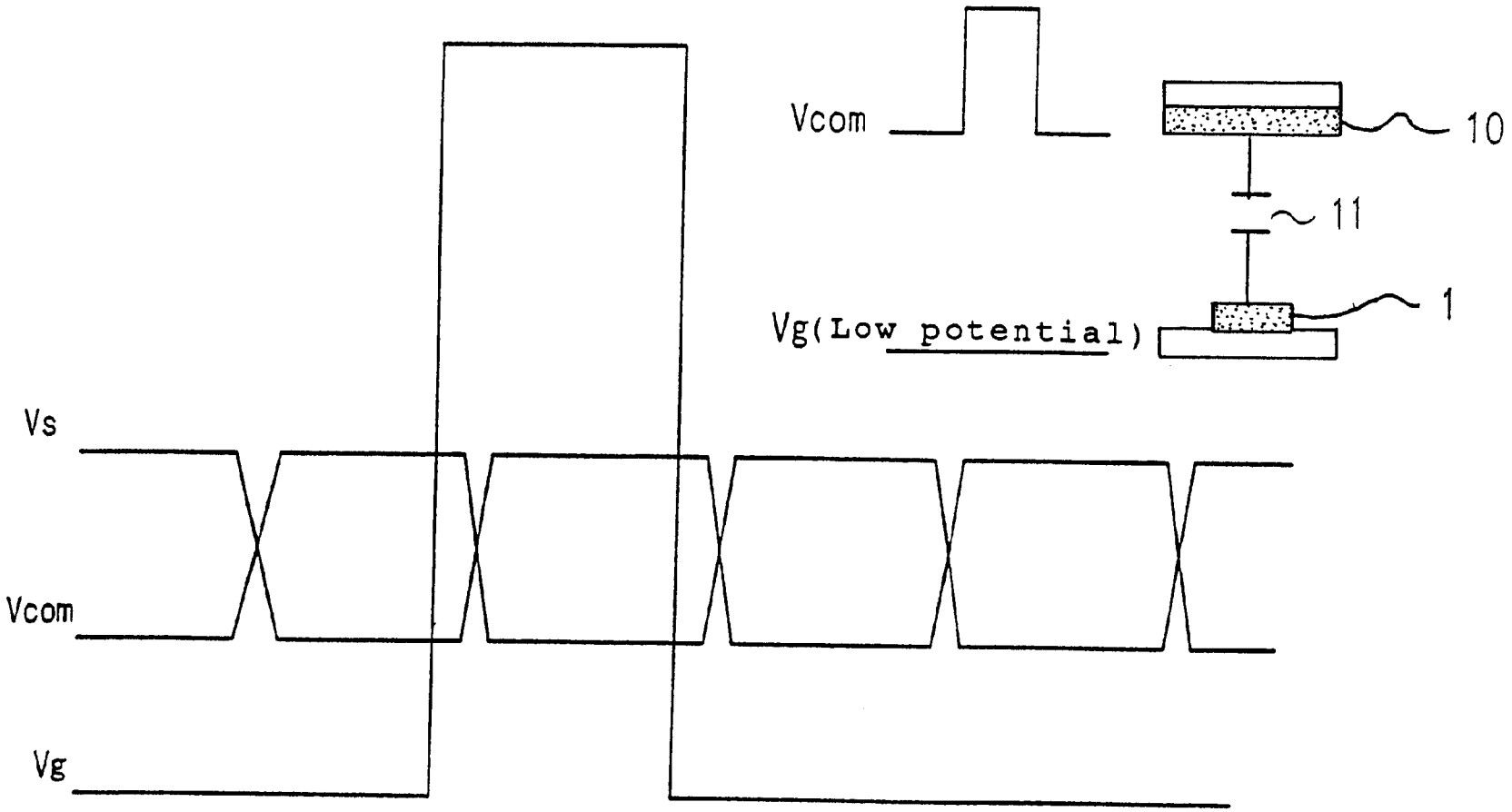
FIG. 4 is a diagram showing a common inversion drive of common Cs line of a liquid crystal display according to the prior art.
Figure 5:
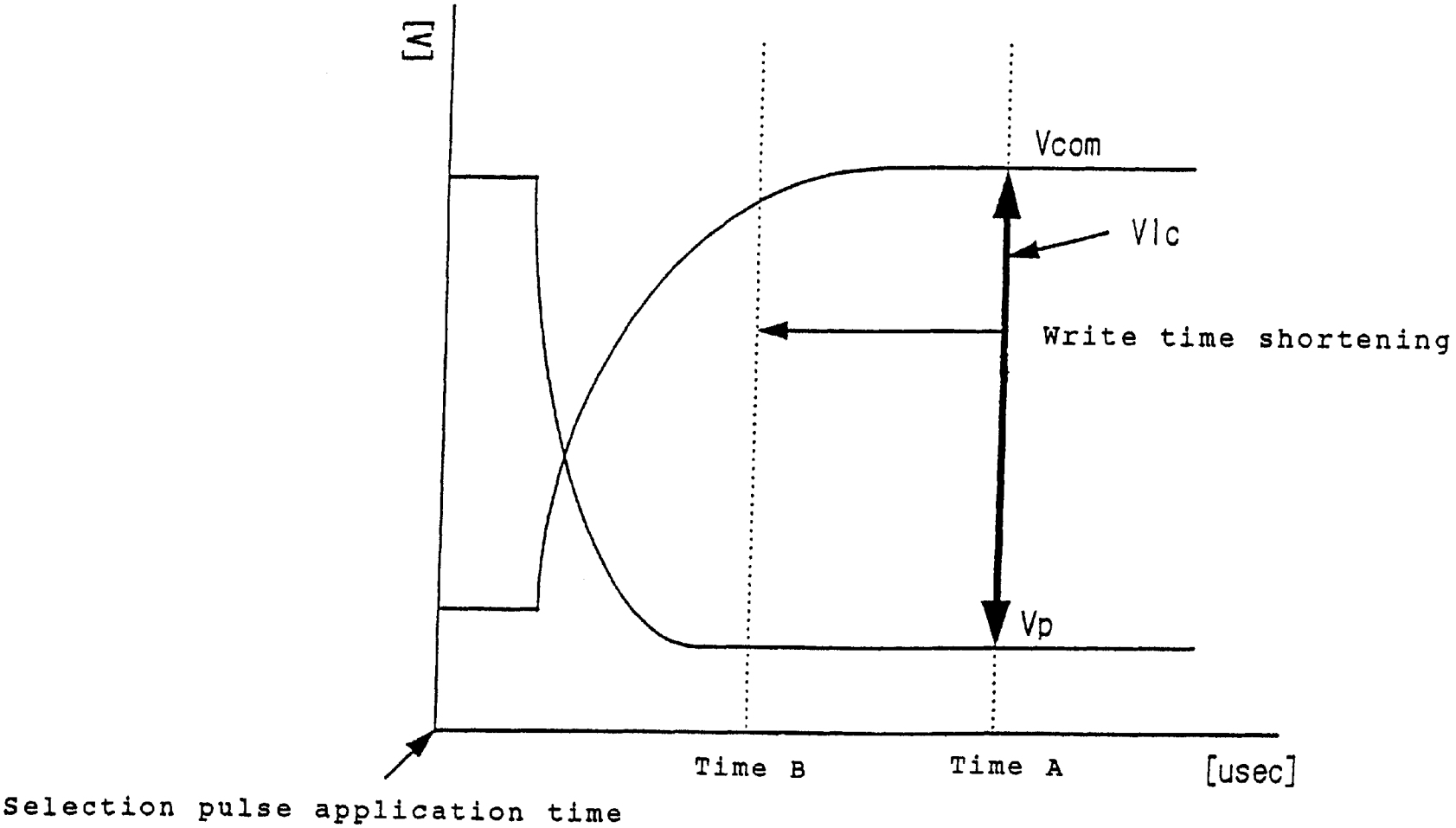
FIG. 5 is a diagram showing a shortage in voltage applied to the liquid crystal because of shortening of horizontal scanning period of the conventional liquid crystal display.
Figure 6:
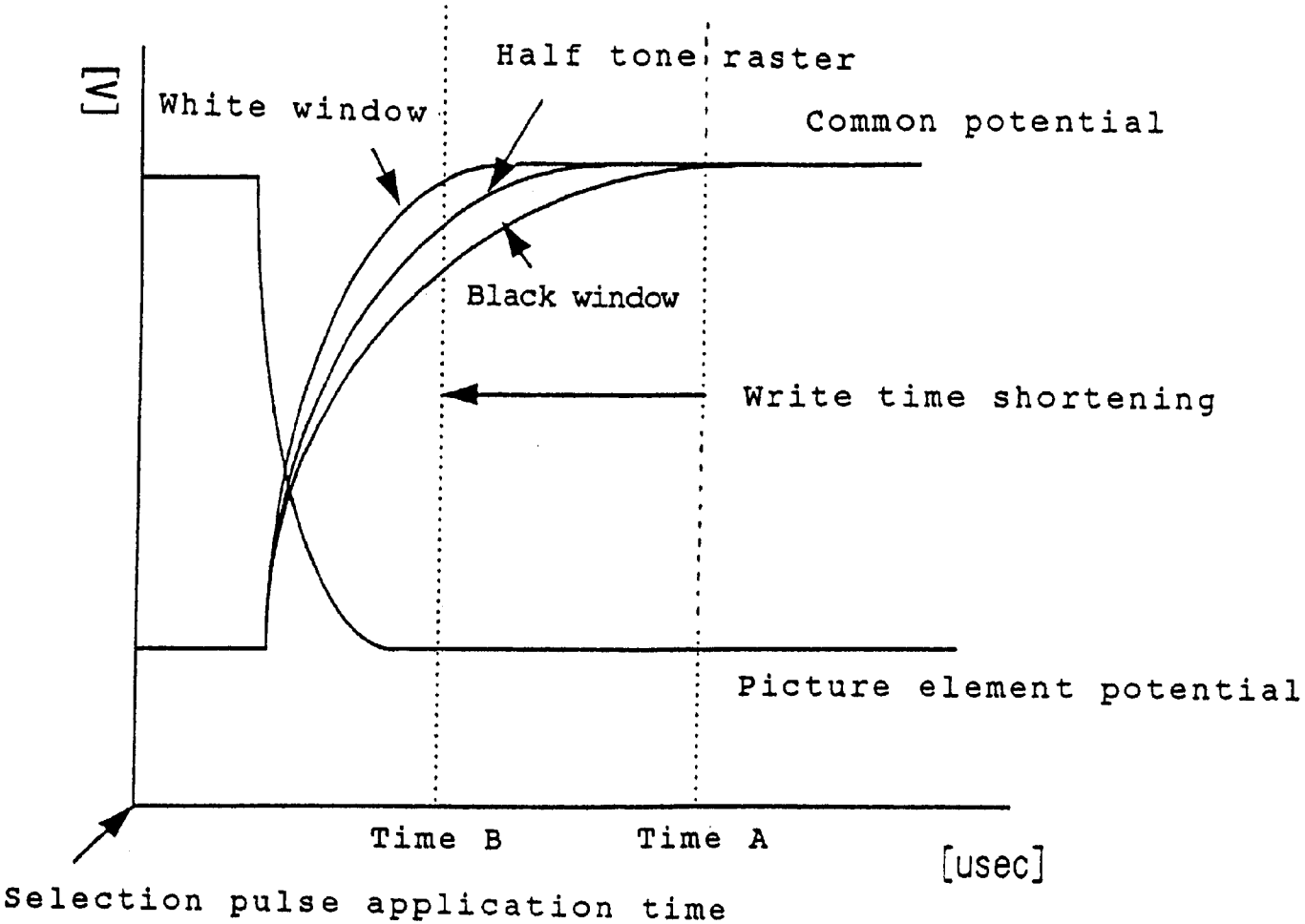
FIG. 6 is a diagram showing an increase of crosstalk ratio because of shortening of horizontal scanning period of the conventional liquid crystal display.

As the equivalent circuit of the active matrix liquid crystal display according to example 1 is same as that shown in FIG. 3, the equivalent circuit is herein described with reference to FIG. 3.

The common inversion drive system of common Cs line is a drive system having a picture element structure in which an auxiliary electrode 8 being an electrode on one side of an auxiliary capacity 7 is connected to a Cs line serving as a common line to which the common electrode 10 is connected, and in which the common potential Vcom is converted to an ac for each horizontal scanning period.

The common inversion drive system of common Cs line according to example 1 is hereinafter described.

In a drive system in which the gate potential Vg being a selection pulse is inputted to any optional gate line 1, the source potential Vs being a gradation signal converted to an ac for each horizontal scanning period is applied to the source line 2, and the common potential Vcom converted to the ac for each horizontal scanning period is applied to the common electrode 10, Low potential of the gate potential Vg is synchronized with the common potential Vcom at the same phase and same amplitude.

In this manner, by fixing the potential difference between the gate line 1 and the common electrode 10, and by equalizing the potential difference V at the time of low potential of the common potential Vcom to the potential difference V' at the time of high potential, and by reducing the transfer of charge between the gate line and the common electrode, it becomes possible to reduce the influence from parasitic capacity between the gate line and the common electrode which is a time constant component of the common potential Vcom.

EXAMPLE 2.

Figure 2:
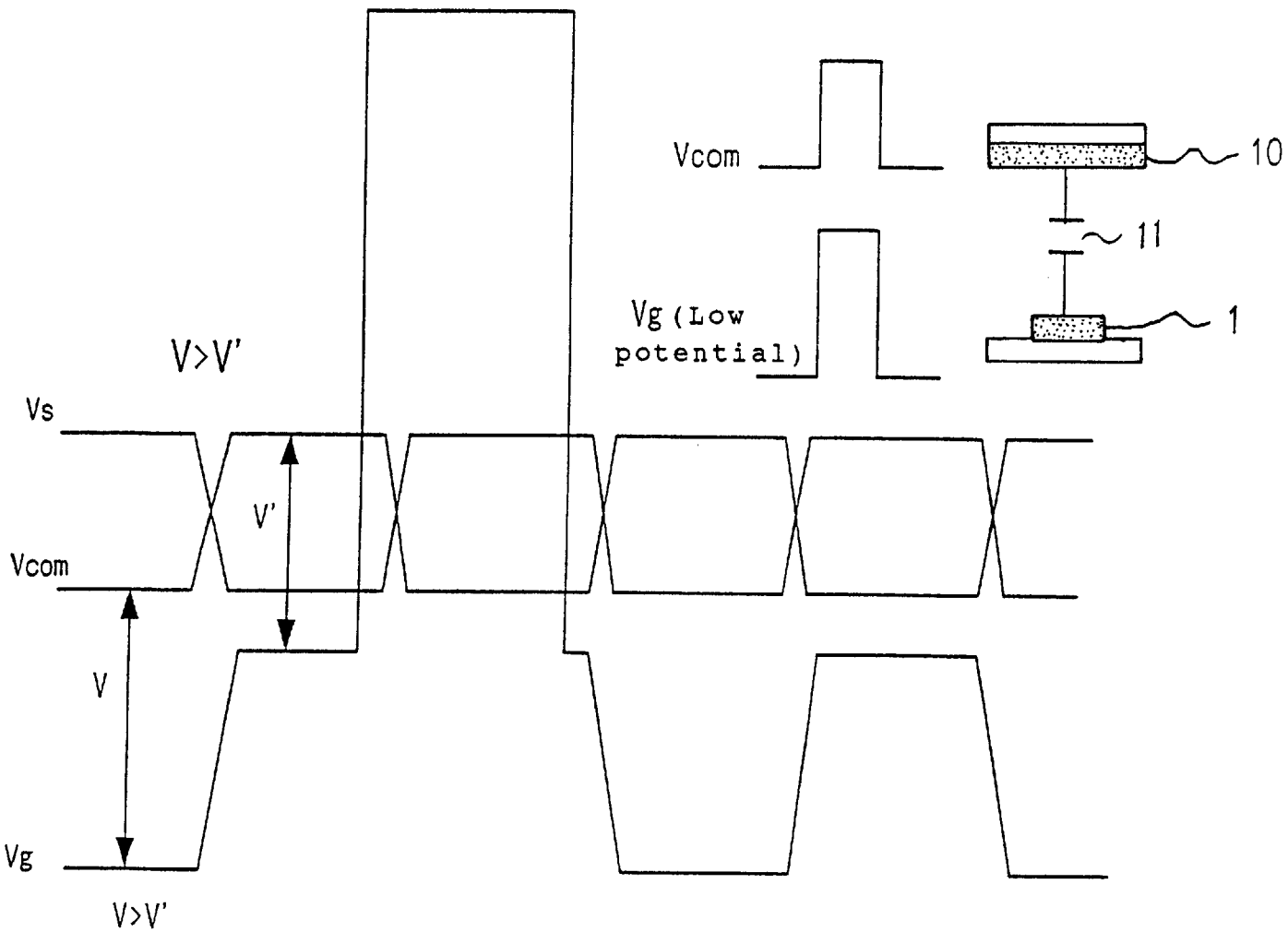
FIG. 2 is a diagram showing a common inversion drive of common Cs line of a liquid crystal display according to example 2 of the invention.

FIG. 2 is a diagram showing a common inversion drive of common Cs line of a liquid crystal display and a drive system in the common Cs structure according to example 2 of the invention.

In the drawing, reference numeral 1 indicates a gate line, numeral 10 indicates a common electrode, and numeral 11 indicates a capacity between the gate line and the common electrode. Vg indicates a gate potential being a selection pulse signal, Vcom indicates a common potential applied to the common electrode, and Vs indicates a source potential being a gradation signal.

As the equivalent circuit of the active matrix liquid crystal display according to example 2 is same as that shown in FIG. 3, the equivalent circuit is herein described with reference to FIG. 3.

The common inversion drive system of common Cs line according to example 2 is hereinafter described.

In a drive system in which the gate potential Vg being a selection pulse is inputted to any gate line 1, the source potential Vs being a gradation signal converted to an ac for each horizontal scanning period is applied to the source line 2, and the common potential Vcom converted to the ac for each horizontal scanning period is applied to the common electrode 10. A difference from example 1 exists in that amplitude of Low potential of the gate potential Vg synchronized with the common potential Vcom is larger than the amplitude of the common electrode Vcom. That is, with regard to the potential difference between the gate line 1 and the common electrode 10, a potential difference V at the time of low potential of the common potential Vcom is established to be larger than the potential difference V' at the time of high potential.

A superiority of example 2 to example 1 exists in that by increasing the amplitude of Low potential of the gate potential vg, a delay of the common potential at the time of inversion of the common potential becomes small, due to the coupling between the gate line and the common electrode, as compared with example 1.

It should also be understood that the foregoing relates to only several preferred embodiments of the invention, and that it is intended to cover all changes and modifications of the examples of the invention herein chosen for the purposes of the disclosure, which do not constitute departures from the spirit and scope of the invention.

What is claimed is:

1. A liquid crystal display comprising: a picture element electrode connected to a gate line and to a source line provided orthogonal to said gate line through a switching device; a display panel arranged facing to said picture element electrode and in which a picture element having a common electrode holding a liquid crystal between the picture element electrode and the common electrode is provided to form a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or a low potential for each scanning period to the common electrode of the display panel; wherein the second voltage changes synchronously with the common potential, and with respect to a potential difference between the second voltage and the common potential, the potential difference at the high potential of the common potential is smaller than that at the low potential of the common potential.

2. The liquid crystal display according to claim 1, wherein an auxiliary electrode connected to the picture element electrode through an auxiliary capacity is provided in the picture element, and the auxiliary electrode of each picture element is commonly connected.

3. A liquid crystal display comprising: a picture element electrode connected to a gate line and to a source line provided orthogonal to said gate line through a switching device; a display panel arranged facing to said picture element electrode and in which a picture element having a common electrode holding a liquid crystal between the picture element electrode and the common electrode is provided to form a matrix; a drive circuit for applying a gate potential having a first voltage for selecting the gate line and a second voltage for not selecting the gate line (first voltage>second voltage) to the gate line of said display panel; and a common electrode generation circuit for applying a common potential inverting to a high potential or a low potential for each scanning period to the common electrode of the display panel; wherein, in the picture element, an auxiliary electrode connected to the picture electrode element through an auxiliary capacity is provided, the auxiliary electrode of each picture element is commonly connected, the second voltage changes synchronously with the common potential, and with respect to the potential difference between the second voltage and the common potential, the potential difference at the high potential of the common potential is equal to that at the low potential of the common potential.

* * * * *